US007018236B2

(12) United States Patent
Nishio et al.

(10) Patent No.: US 7,018,236 B2
(45) Date of Patent: Mar. 28, 2006

(54) CONNECTOR WITH RESIN MOLDED PORTION

(75) Inventors: Atsushi Nishio, Ibaraki (JP); Yoshinori Ohta, Ibaraki (JP); Yasuhiko Shinohara, Ibaraki (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/931,335

(22) Filed: Aug. 31, 2004

(65) Prior Publication Data

US 2005/0112944 A1 May 26, 2005

(30) Foreign Application Priority Data

Nov. 21, 2003 (JP) ..... 2003-392811

(51) Int. Cl.
*H01R 13/58* (2006.01)

(52) U.S. Cl. ..... 439/606; 439/445

(58) Field of Classification Search ..... 439/606, 439/604, 445, 464; 264/247
See application file for complete search history.

(56) References Cited

U.S. PATENT DOCUMENTS

| | | | | |
|---|---|---|---|---|
| 3,426,121 | A * | 2/1969 | Faulkner | 264/247 |
| 4,704,091 | A * | 11/1987 | Owens et al. | 439/606 |
| 6,195,830 | B1 * | 3/2001 | Bruschi | 264/247 |
| 6,579,485 | B1 * | 6/2003 | Smith et al. | 264/247 |
| 2003/0119359 | A1 * | 6/2003 | Fung | 439/606 |

* cited by examiner

*Primary Examiner*—Hien Vu
(74) *Attorney, Agent, or Firm*—Patents & TMS, P.C.

(57) ABSTRACT

A connector includes a connector main body 1 having a metallic electrical connecting portion 2, an inner molded portion 10*a* provided outside the connector main body and having a pair of protrusions 12 which are integrally formed on the opposite surfaces of the inner molded portion 10*a*, and an outer molded portion 20*a* provided outside the inner molded portion so that the protrusions 12 are partially exposed on the outer surface of the outer molded portion 20*a*. The pair of protrusions 12 protrude toward a pair of metal molds for molding the outer molding portion, respectively.

2 Claims, 8 Drawing Sheets

CONNECTOR WITH RESIN MOLDED PORTION

This application claims the benefit of Japanese Patent Application No. 2003-392811, filed Nov. 21, 2003.

BACKGROUND OF THE INVENTION

1. Field of the Invention

The present invention is related to a connector, and in particular to a connector having a connector main body, an inner molded portion provided outside the connector main body, and an outer molded portion provided outside the inner molded portion.

2. Description of the Prior Art

A prior art L-shaped connector is shown in FIG. 5 to FIG. 8. The process for manufacturing this connector can be divided into three major steps. FIG. 5 shows the finished state of a connector main body 1 in the first step, and this connector main body 1 is constructed mainly from a metallic connecting portion 2, a cable 3, lead wires 4, a metallic holding member 5 and a plastic molded member 6.

In the second step, polypropylene is filled into metal molds for press molding for an inner molded portion to form an inner molded portion 10 on the outside of the connector main body 1 formed in the first step. The polypropylene of the inner molded portion 10 is relatively hard, and this holds the sheath of the cable 3 so that strength is ensured when the cable 3 is pulled.

Further, when the inner molded portion 10 is formed, the sheath of the cable 3 is pressed by the bosses of the metal molds for press molding so that the cable 3 is arranged at an appropriate position inside the inner molded portion 10. The impressions of the bosses remain as boss holes 11.

In the third step, a flexible synthetic resin such as polyvinyl chloride or the like is filled into metal molds for press molding for an outer molded portion to form an outer molded portion 20 on the outside of the inner molded portion 10 formed in the second step. At this time, a portion 3*a* which covers the cable 3 of the inner molded portion 10 is pressed by the bosses of the metal molds for press molding, and the inner molded portion 10 is arranged at an appropriate position inside the outer molded portion 20. The impressions of the bosses remain as boss holes 21.

By fixing the cable 3 at the appropriate position by the inner molded portion 10, the cable 3 is not exposed to the outside when the outer molded portion 20 is formed, and this makes it possible to achieve an outside appearance having a high degree of design freedom. In this regard, if the connector only had the inner molded portion 10, it would be difficult to arrange the cable 3 at the appropriate position, and there are instances where the cable 3 would be exposed out of the connector (that is, out of the inner molded portion).

In the prior art connector described above, however, when the outer molded portion 20 is formed on the outside of the inner molded portion 10, only the cable 3 is pressed by the bosses of the metal molds for press molding. Therefore, only a circumferential portion 22 of the cable 3 is arranged at the appropriate position.

However, means such as the bosses for positioning the inner molded portion 10 are not present at a central portion 23 of the connector. For this reason, there are cases where the inner molded portion 10 is fixed in a misaligned manner inside the central portion 23 of the connector. In particular, there are cases that, as shown in FIG. 8, the inner molded portion 10 is misaligned in the direction shown by the dashed arrow (or in the opposite direction thereof) with respect to the facing directions (shown by the solid arrows in FIG. 8) of both metal molds used for press molding the outer molded portion 20. This creates an uneven wall thickness for the outer molded portion 20.

In order to solve this problem, it has been proposed that the metal molds for press molding be provided with bosses at the central portion 23 of the connector. However, in such a case, because boss holes due to these bosses will remain in the surface of the outer molded portion 20, moisture and the like that penetrates from the boss holes will corrode the portion of the metallic holding member 5 exposed at the surface of the inner molded portion 10 (see FIG. 6). Further, the presence of the boss holes will mar the attractive appearance of the connector surface.

SUMMARY OF THE INVENTION

In view of the problems described above, it is an object of the present invention to provide a connector which can prevent misalignment of an inner molded portion without the use of bosses when an outer molded portion is formed.

In order to achieve the object, the present invention is directed to a connector which includes a connector main body, an inner molded portion having positioning means and provided outside the connector main body, and an outer molded portion provided outside the inner molded portion so that the positioning means are partially exposed on the outer surface of the outer molded portion.

According to the present invention, it is possible to prevent misalignment of the inner molded portion with respect to the outer molded portion when the outer molded portion is formed by providing the positioning means on the inner molded portion. Further, it is also possible to prevent the outer molded portion from having an uneven wall thickness due to the misalignment of the inner molded portion. Further, since the positioning means are provided on the inner molded portion, it is unnecessary to provide bosses on the metal molds for press molding the outer molded portion. As a result, it is possible to prevent a problem caused by boss holes that remain in the outer molded portion.

In the connector according to the present invention, it is preferred that the positioning means includes a pair of protrusions integrally formed with the inner molded portion, and the pair of protrusions protrude toward a pair of molds for press molding the outer molded portion, respectively.

As described above, since the pair of protrusions protrude toward a pair of molds for molding the outer molded portion, respectively, the distance from the surface of both metal molds to the inner molded portion can be regulated accurately. In this way, the positioning of the inner molded portion in this direction can be carried out with high accuracy.

Further, it is preferred that the pair of protrusions respectively protrude from the corresponding parts of the left and right surfaces of the inner molded portion in a symmetrical manner.

As described above, since the pair of protrusions respectively protrude from the corresponding parts of the left and right surfaces of the inner molded portion in a symmetrical manner, the pressure of both metal molds is applied evenly to each protrusion. For this reason, it is possible to efficiently prevent misalignment of the inner molded portion with respect to the outer molded portion due to the pressure of the both metal molds.

Further, in the connector according to the present invention, it is preferred that the pair of positioning portions extend along an inclination restricting direction on the inner molded portion.

Since the pair of positioning portions extend along an inclination restricting direction on the inner molded portion as described above, it is possible to prevent inclination of the inner molded portion in the extending direction of the positioning portions over large area.

These and other objects, operations and effects of the present invention will be apparent when the following description of the preferred embodiment will be considered taken in conjunction with the appended drawings.

DETAILED DESCRIPTION OF THE INVENTION

The preferred embodiment of a connector according to the present invention is described below with reference to the drawings.

Figure 1:
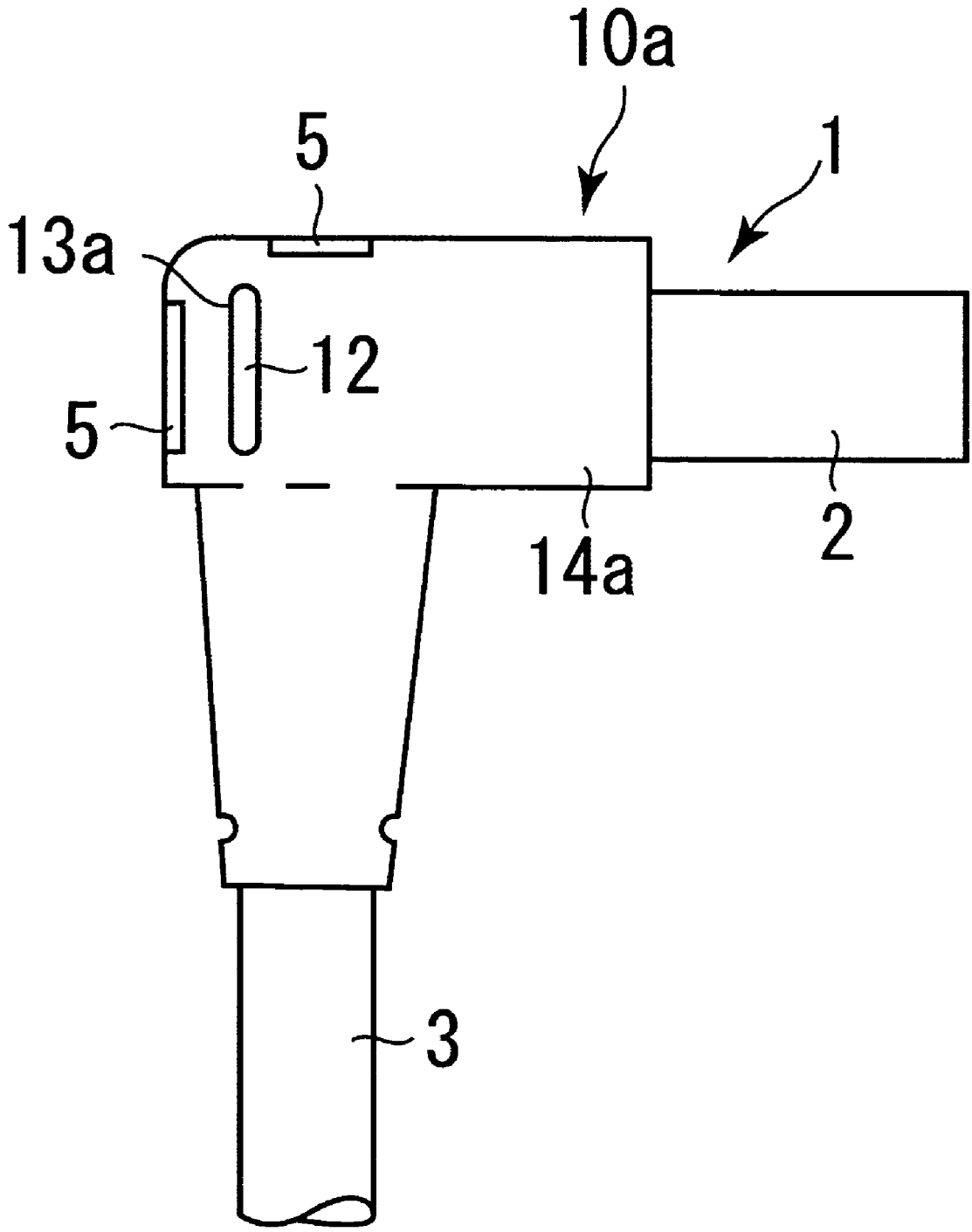
FIG. 1 is a left side view showing a connector main body 1 in a state where an inner molded portion is formed on the connector main body according to an embodiment of the present invention.
Figure 2:
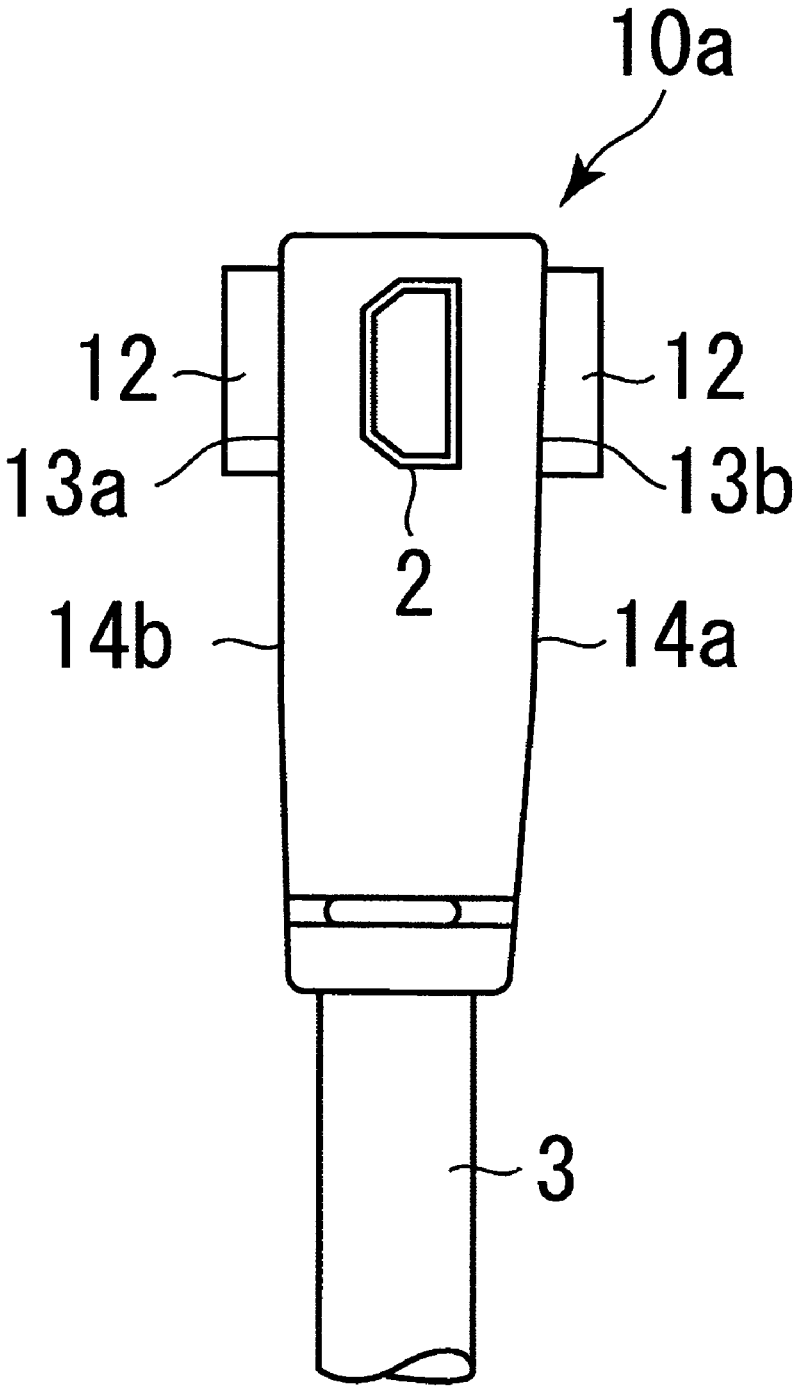
FIG. 2 is a front view showing the connector main body shown in FIG. 1.

FIG. 1 and FIG. 2 show an L-shaped connector main body 1 in a state where an inner molded portion has been formed on the connector main body 1 according to the preferred embodiment of the present invention. As shown in these drawings, the connector main body 1 includes a connecting portion 2, and a cable 3 is connected to the connector main body 1. Further, structural members having the same functions as those structures of the prior art L-shaped connector shown in FIG. 5 to FIG. 8 are described using the same reference numerals.

As shown in FIG. 2, left and right surfaces 14*a*, 14*b* of an inner molded portion 10*a* of the connector of the present embodiment are provided with a pair of positioning portions 12. The positioning portions 12 are formed from a pair of elongated rib-shaped protrusions integrally formed with the inner molded portion 10*a*, and these protrusions protrude respectively in the directions of both metal molds (not shown in the drawings) used for forming an outer molded portion 20*a*. The inner molded portion 10*a* is formed of a relatively hard resin material such as polypropylene and the like.

Further, the positioning portions (protrusions) 12 protrude symmetrically from corresponding portions 13*a*, 13*b* of the left surface 14*a* and the right surface 14*b*, respectively.

The height of the positioning portions 12 from the surfaces 14*a*, 14*b* corresponds to the wall thickness of related portions of the outer molded portion 20*a*.

Figure 8:
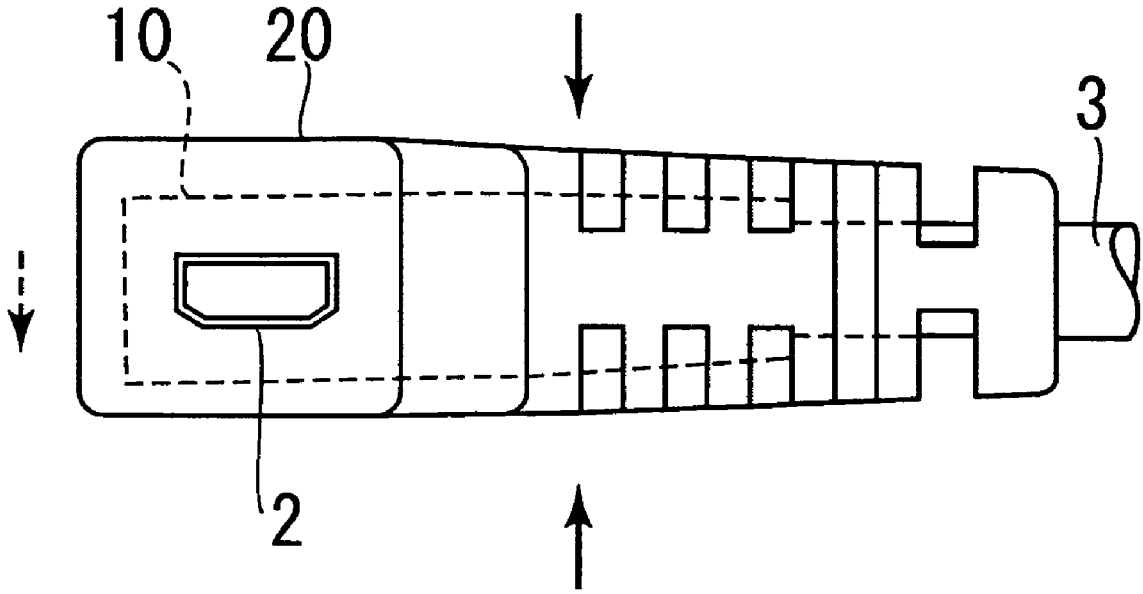
Prior Art Fig. 8
FIG. 8 is an explanation drawing showing a prior art connector in a state where the inner molded portion is misaligned in the direction shown by the dashed arrow inside the outer molded portion.

Further, the positioning portions 12 extend along an inclination restricting direction on the inner molded portion 10. In the present embodiment, the inclination restricting direction is shown by the arrow A in FIG. 3. In this connection, the inner molded portion 10 of the prior art L-shaped connector is shown in FIG. 8 as being inclined in this inclination restricting direction. Further, the inclination restricting direction of the arrow A merely shows one example in the corresponding relationship between the prior art connector and the connector of the present embodiment. In general, the inclination restricting direction is determined from the shapes of the connector and the metal molds, or the position of other bosses and the like.

Further, there are cases where inclination restricting directions are recognized in a plurality of directions. For example, in the case where an inclination restricting direction is also recognized in the direction of the arrow B shown in FIG. 3, the positioning portions (protrusions) 12 are preferably formed to have a cross shape, an L shape, a T shape or the like. Further, the positions and the number of the positioning portions 12 are not limited to the embodiment described above, and a suitable number of positioning portions may be provided at suitable places in accordance with the shape and the size of the connector.

Next, the operation of the present invention will be described with reference to the embodiment described above. The process for manufacturing the connector of the present embodiment can be divided into three major steps in the same way as the prior art L-shaped connector. Namely, after the connector main body 1 is manufactured (see FIG. 1), the inner molded portion 10*a* is formed on the outside of the connector main body 1 by press molding, and then the outer molded portion 20*a* is formed on the outside of the inner molded portion 10*a* by press molding to complete the manufacturing process.

Figure 3:
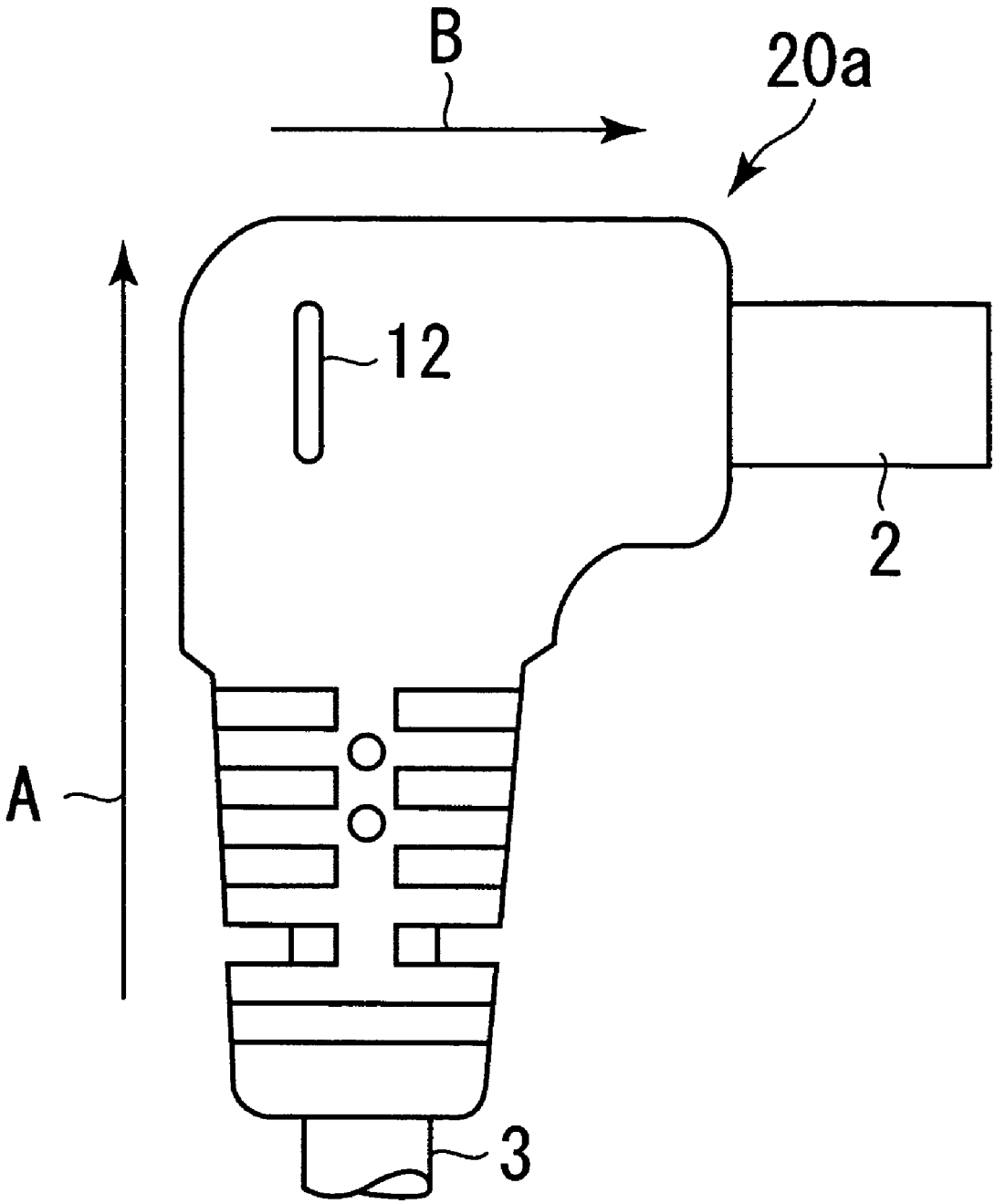
FIG. 3 is a left side view showing an outer molded portion according to the embodiment of the present invention.

The positioning portions 12 protrude respectively in the directions of both metal molds for press molding of the outer molded portion 20*a*. Further, the height of the positioning portions 12 correspond to the wall thickness of the outer molded portion 20*a*. For this reason, as shown in FIG. 3, when the press molding of the outer molded portion 20*a* is completed, the tip portions of the positioning portions 12 are partially exposed from the surface of the outer molded portion 20*a*. Further, FIG. 3 is a left side view showing the completed state of the connector, and the right side view would appear symmetrical to FIG. 3.

In this way, in the present invention, because the positioning portions 12 described above are provided, it is possible to prevent misalignment of the inner molded portion 10*a* with respect to the outer molded portion 20*a* without the use of bosses when the outer molded portion 20*a* is formed. In particular, the present invention is effective in preventing the formation of boss holes in the central portion of the connector.

Further, because the distance from the surface of both metal molds to the inner molded portion 10*a* can be controlled accurately by the positioning portions 12, it is possible to prevent the case where a portion of the inner molded portion 10*a* is exposed to the outside from the surface of the outer molded portion 20*a* due to misalignment of the inner molded portion 10*a* with respect to the outer molded portion 20*a*.

Further, because the positioning portions 12 protrude symmetrically from the corresponding portions 13*a*, 13*b* of the left and right surfaces 14*a*, 14*b* of the inner molded portion 10*a*, the pressure of both metal molds is applied evenly to each positioning portion 12 when the outer molded portion 20*a* is molded. For this reason, it is possible to prevent misalignment of the inner molded portion 10*a* due to the pressure of both metal molds.

Figure 4:
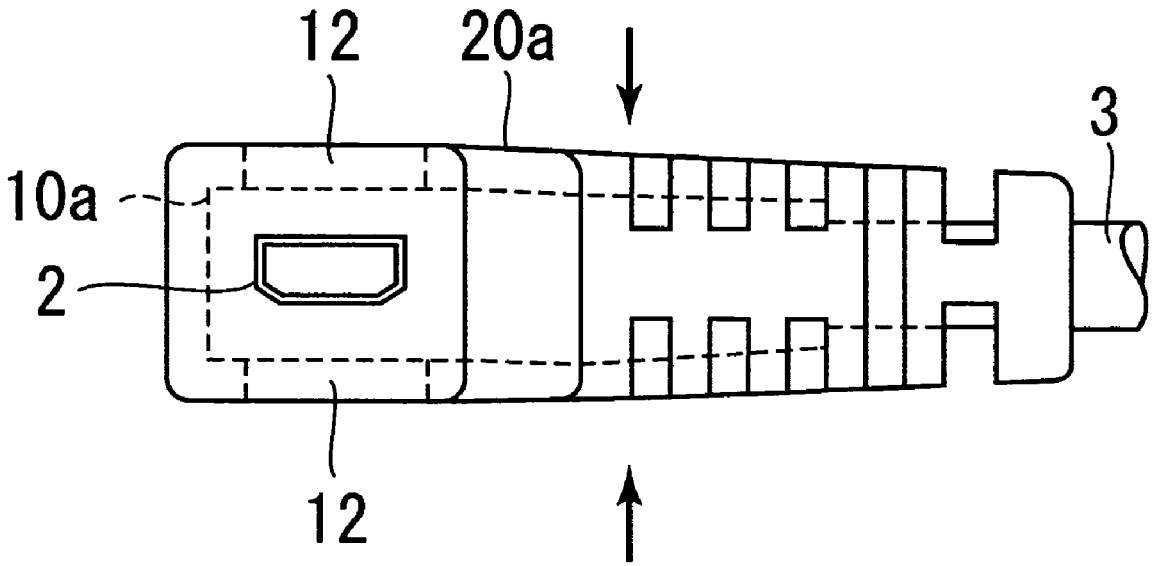
FIG. 4 is an explanation drawing showing the connector according to the embodiment of the present invention, in a state where the inner molded portion is arranged at an appropriate position inside the outer molded portion by positioning portions.
Figure 5:
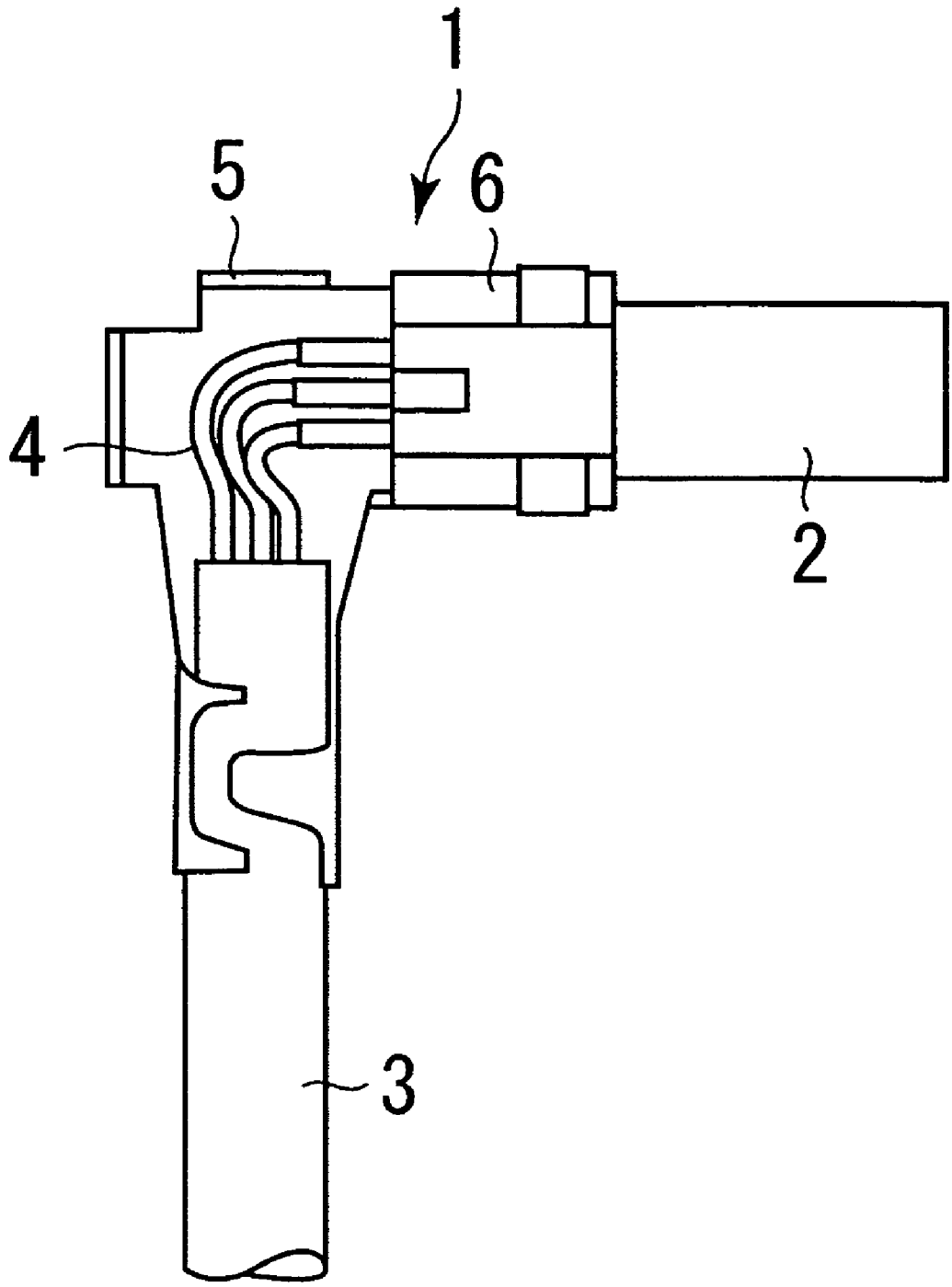
Prior Art Fig. 5
FIG. 5 is a left side view showing a prior art connector main body.
Figure 6:
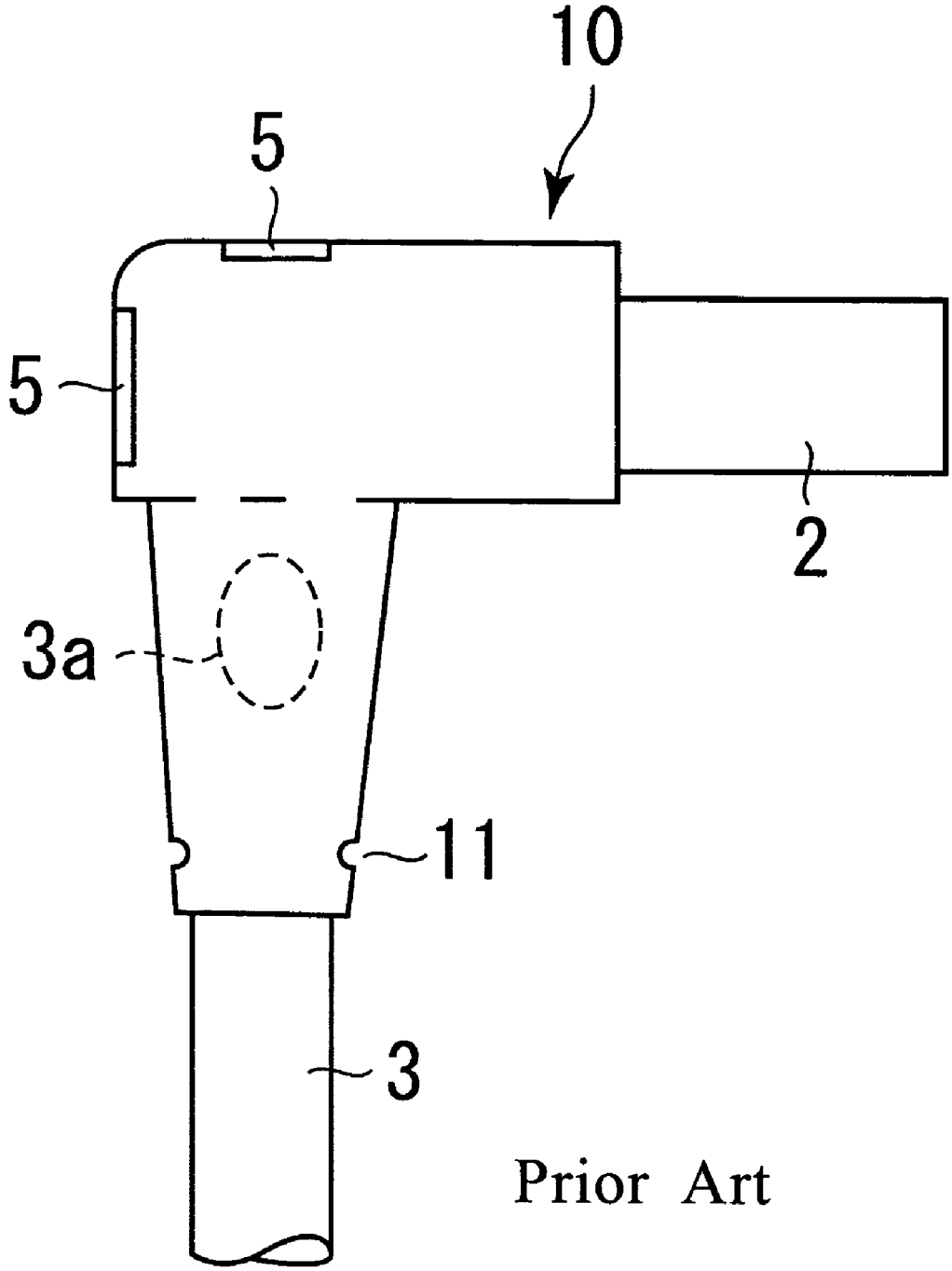
FIG. 6 is a left side view showing a prior art inner molded portion.
Figure 7:
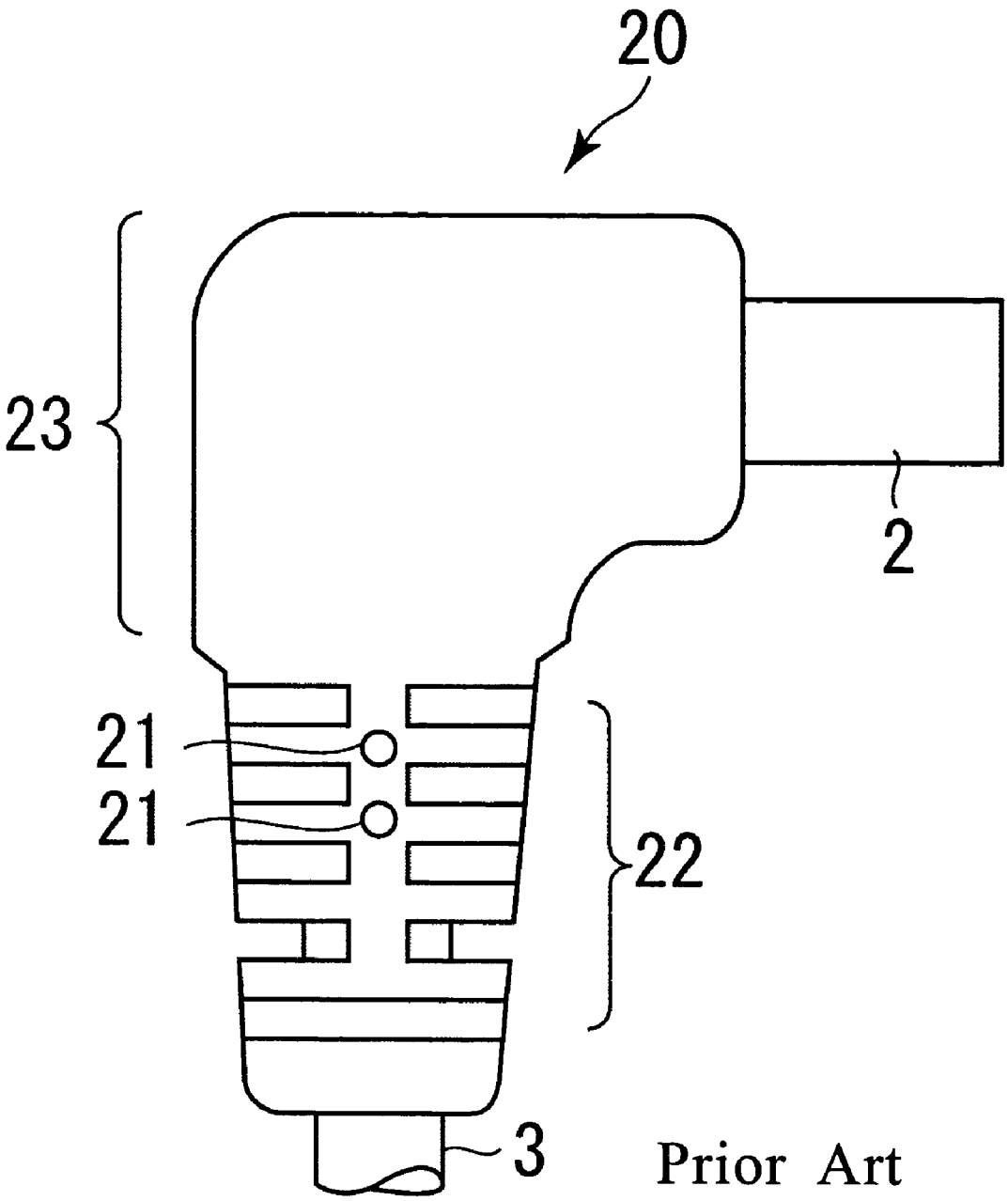
FIG. 7 is a left side view showing a prior art outer molded portion.

As described above, the positioning portions 12 extend along an inclination restricting direction shown by the arrow A in FIG. 3. Because of this, as shown in FIG. 4, it is possible to prevent inclination of the inner molded portion 10*a* in the inclination restricting direction.

Further, the description given above was related to an L-shaped connector, but the connector of the present invention is not limited to any specific shape. For example, the present invention can be applied to a so-called straight type connector in which the connecting portion and the cable extend in the same direction.

Finally, it should be understood that the present invention is not limited to the embodiment described above, and it is possible to make various changes and improvements without departing from the scope and spirit of the invention defined in the appended claims.

What is claimed is:

1. A connector, comprising:

a substantially L-shaped connector main body having a conductive cable and a metallic electrical connecting portion, the metallic electrical connecting portion having a predetermined width and extending in a predetermined direction;

an inner molded portion provided outside the connector main body, and having opposite surfaces wherein the inner molded portion includes a positioning means comprised of a pair of elongated rib-shaped portions integrally formed on the opposite surfaces of the inner molded portion respectively in a symmetrical manner; and an outer molded portion provided outside the inner molded portion so that the pair of elongated rib-shaped portions is partially exposed on the outer surface of the outer molded portion wherein the elongated rib-shaped portions protrude toward a pair of metal molds for forming the outer molded portion, respectively, so that the metallic electrical connecting portion is positioned with respect to the outer molded portion without inclination by means of the rib-shaped portions when the outer molded portion is molded outside the inner molded portion using the pair of molds, and each of the elongated rib-shaped portions extending along a direction substantially perpendicular to the extending direction of the metallic electrical connecting portion and having substantially the same width as the width of the metallic electrical connecting portion; wherein each of the rib-shaped portions extends along the extending direction of the cable which extends from an end portion of the connector body.

2. The connector as claimed in claim 1, wherein, the connector including a first portion having a base side and a tip side and a second portion which extends from the base side of the first portion substantially perpendicular to the first portion, wherein the metallic electrical connecting portion is arranged in the tip side of the first portion and the cable is connected to the second portion, and the elongated rib-shaped portions are arranged at the base side of the first portion.

* * * * *